US008930182B2

(12) United States Patent
Ben-David et al.

(10) Patent No.: US 8,930,182 B2
(45) Date of Patent: Jan. 6, 2015

(54) VOICE TRANSFORMATION WITH ENCODED INFORMATION

(75) Inventors: Shay Ben-David, Haifa (IL); Ron Hoory, Ramat Yishay (IL); Zvi Kons, Yoqneam Ilit (IL); David Nahamoo, New York, NY (US)

(73) Assignee: International Business Machines Corporation, Armonk, NY (US)

( * ) Notice: Subject to any disclaimer, the term of this patent is extended or adjusted under 35 U.S.C. 154(b) by 787 days.

(21) Appl. No.: 13/049,924

(22) Filed: Mar. 17, 2011

(65) Prior Publication Data

US 2012/0239387 A1 Sep. 20, 2012

(51) Int. Cl.

| | |
|---|---|
| ***G10L 21/00*** | (2013.01) |
| ***G10L 25/90*** | (2013.01) |
| ***G10L 25/93*** | (2013.01) |
| ***G10L 21/003*** | (2013.01) |
| *G10L 19/018* | (2013.01) |

(52) U.S. Cl.

CPC ..... *G10L 21/003* (2013.01); *G10L 19/018* (2013.01)

USPC ..... 704/201; 704/206; 704/207; 704/209; 704/224

(58) Field of Classification Search

CPC .... H05K 999/99; G10L 15/22; G10L 13/043; G10L 17/005; G10L 13/08; H04B 1/665; G11C 2207/16; G11B 20/10527; G11B 20/00086; H04L 9/06; H04L 9/08; H04L 9/18; G06F 7/725; H04K 1/02; H04K 1/003; H04K 1/06; H04K 1/04; H04K 1/006; H04K 1/00; H04N 7/167; H04N 7/1713; H04H 60/23; H04H 20/31; A47C 27/144

USPC ..... 704/203, 269, 270, 272, 273, 200.1, 704/201, 260; 700/94; 380/28, 30, 31, 32, 380/35, 37, 38, 42, 43, 59, 219, 220, 236, 380/237, 238, 275, 287

See application file for complete search history.

(56) References Cited

U.S. PATENT DOCUMENTS 4,278,837 A * 7/1981 Best ..... 713/190
4,882,751 A * 11/1989 Kotzin et al. ..... 380/270

(Continued)

FOREIGN PATENT DOCUMENTS

DE 102006041509 3/2007
EP 1750426 12/2001

(Continued)

OTHER PUBLICATIONS

Skopin, Dmitriy E., et al. "Advanced algorithms in audio steganography for hiding human speech signal." Advanced Computer Control (ICACC), 2010 2nd International Conference on. vol. 3. IEEE, 2010.*

*Primary Examiner* — Brian Albertalli

(57) ABSTRACT

Method, system, and computer program product for voice transformation are provided. The method includes transforming a source speech using transformation parameters, and encoding information on the transformation parameters in an output speech using steganography, wherein the source speech can be reconstructed using the output speech and the information on the transformation parameters. A method for reconstructing voice transformation is also provided including: receiving an output speech of a voice transformation system wherein the output speech is transformed speech which has encoded information on the transformation parameters using steganography; extracting the information on the transformation parameters; and carrying out an inverse transformation of the output speech to obtain an approximation of an original source speech.

23 Claims, 8 Drawing Sheets

(56) References Cited

U.S. PATENT DOCUMENTS

| | | | | |
|---|---|---|---|---|
| 5,091,941 | A * | 2/1992 | Needle et al. | 380/43 |
| 5,168,522 | A * | 12/1992 | Simanis et al. | 380/38 |
| 6,064,737 | A * | 5/2000 | Rhoads | 713/176 |
| 6,278,781 | B1 * | 8/2001 | Rhoads | 380/247 |
| 6,425,082 | B1 * | 7/2002 | Matsui et al. | 713/176 |
| 8,626,493 | B2 * | 1/2014 | Tischer | 704/200 |
| 2002/0168089 | A1 | 11/2002 | Guenther et al. | |
| 2003/0040326 | A1 * | 2/2003 | Levy et al. | 455/466 |
| 2003/0149881 | A1 * | 8/2003 | Patel et al. | 713/186 |
| 2003/0154073 | A1 * | 8/2003 | Ota et al. | 704/207 |
| 2004/0068399 | A1 * | 4/2004 | Ding | 704/200.1 |
| 2005/0144006 | A1 | 6/2005 | Oh | |
| 2009/0177742 | A1 * | 7/2009 | Rhoads et al. | 709/203 |
| 2010/0049522 | A1 | 2/2010 | Tamura et al. | |
| 2011/0131047 | A1 * | 6/2011 | Geiser et al. | 704/270 |
| 2012/0046948 | A1 * | 2/2012 | Leddy et al. | 704/260 |

FOREIGN PATENT DOCUMENTS

| | | |
|---|---|---|
| WO | 0167671 | 9/2001 |
| WO | 2007120453 | 10/2007 |
| WO | 2008045950 | 4/2008 |
| WO | 2010025546 | 3/2010 |

* cited by examiner

VOICE TRANSFORMATION WITH ENCODED INFORMATION

BACKGROUND

This invention relates to the field of voice transformation or voice morphing with encoded information. In particular, the invention relates to voice transformation for preventing fraudulent use of modified speech.

Voice transformation enables speech samples from one person to be modified so that they sound as if they were spoken by someone else. There are two types of transformations:

- Modify the voice without a specific target. For example, lowering the pitch by some constant amount.
- Modify the voice so it will sound as close as possible to a target speaker.

There are many uses for voice transformation. The following are some examples:

- Film dubbing. This allows one actor to dub several voices in a film and also allows dubbing in different languages while maintaining the original actor voice.
- Telecom services. Various services allow a caller to modify his voice. For example, sending a birthday greeting to a child with his favorite cartoon character or a celebrity voice.
- Toys. Voice transformation can be used in games and toys for generating various voices. For example, a parrot like doll that repeats what is being said to it in a parrot voice.
- Music industry. Voice transformation tools such as the AUTO-TUNE tool (AUTO-TUNE is a trade mark of Antares Audio Technologies) have become very popular in the music industry.
- Online chat. Chatting text and SMS (Short Message Service) can be converted into speech with a voice that is similar to the sender's voice.
- Gaming. This allows online game players to speak with the voice of their online avatar instead of their own voice.

However, in the wrong hands voice transformation tools can also be used improperly. Examples of improper use include the following

- Impersonating another person without his consent.
- Voice disguising while performing illegal act to avoid identification.

At present, it is usually possible to distinguish between a natural and transformed voice and it is not possible to mimic fully a different speaker. However, as research progresses it is expected that within a few years the quality of voice transformation system might be high enough to be indistinguishable from natural voice and indistinguishable from a copied speaker.

BRIEF SUMMARY

According to a first aspect of the present invention there is provided a method for voice transformation, comprising: transforming a source speech using transformation parameters; encoding information on the transformation parameters in an output speech using steganography; wherein the source speech can be reconstructed using the output speech and the information on the transformation parameters.

According to a second aspect of the present invention there is provided a method for reconstructing a voice transformation, comprising: receiving an output speech of a voice transformation system wherein the output speech is transformed speech which has encoded information on the transformation parameters using steganography; extracting the information on the transformation parameters; and carrying out an inverse transformation of the output speech to obtain an approximation of an original source speech.

According to a third aspect of the present invention there is provided a system for voice transformation comprising: a processor; a voice transformation component for transforming a source speech using transformation parameters; and a steganography component for encoding information on the transformation parameters in an output speech using steganography; wherein the source speech can be reconstructed using the output speech and the information on the transformation parameters.

According to a fourth aspect of the present invention there is provided a system for reconstructing a voice transformation, comprising: a processor; a speech receiver for receiving an input speech, wherein the input speech is transformed speech which has encoded information on the transformation parameters using steganography; a steganography decoder component for decoding the information on the transformation parameters from the input speech; and a voice reconstruction component for carrying out an inverse transformation of the input speech to obtain an approximation of an original source speech.

According to a fifth aspect of the present invention there is provided a computer program product for voice transformation, the computer program product comprising: a computer readable storage medium having computer readable program code embodied therewith, the computer readable program code comprising: computer readable program code configured to: transform a source speech using transformation parameters; and encode information on the transformation parameters in an output speech using steganography; wherein the source speech can be reconstructed using the output speech and the information on the transformation parameters.

BRIEF DESCRIPTION OF THE SEVERAL VIEWS OF THE DRAWINGS

The subject matter regarded as the invention is particularly pointed out and distinctly claimed in the concluding portion of the specification. The invention, both as to organization and method of operation, together with objects, features, and advantages thereof, may best be understood by reference to the following detailed description when read with the accompanying drawings in which:

Figure 1:
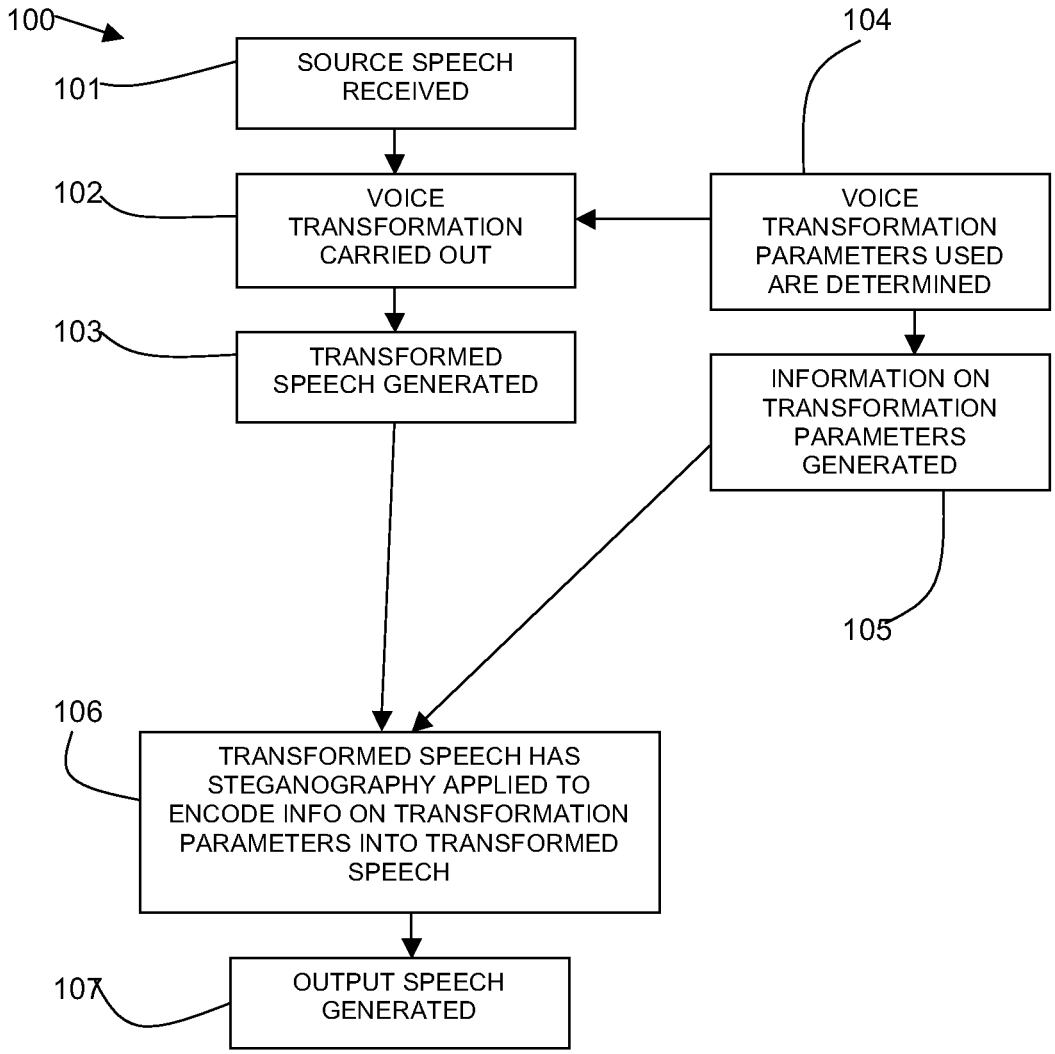
FIG. 1 is a flow diagram of a first embodiment of a method of voice transformation in accordance with the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numbers may be repeated among the figures to indicate corresponding or analogous features.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Method, system and computer program product are described in which steganography or watermarking data is added to transformed speech so it can be identified and transformed back to the original voice. Adding steganographic data to the speech has only small impact on quality so the output of the system will still be usable for most ordinary applications.

Transformation parameters are encoded into the transformed speech by means of steganography so that the original speech can be reconstructed. The transformation parameters can be retrieved from the transformed speech and used to reconstruct the original speech by applying the inverse transform.

In one embodiment, the transformation parameters may be added using steganography after the voice transformation has taken place.

In another embodiment, a voice transformation system may encode the transformation parameters by encoding the transformation parameters in the modulation of the parameters of the transformed speech.

In some cases the transformation can not be inverted. In such cases, the encoded transformation parameters are those that when applied to the modified speech should bring it as close as possible to the original speech. Instead of encoding the transformation parameters themselves, the inverse parameters may be encoded.

If someone uses this to commit a fraudulent or criminal act (for example, calling a bank while impersonating a different person) then the watermarking in the recorded speech can be detected and used to invert the transformed speech back to the original speech (or a close approximation to it). This can be used later to trace or detect the user.

Anyone who would like to avoid the possibility that someone might be calling them while using a voice transformation system may add a system that detects if the watermarking is present and issues an alert if it exists in the incoming speech.

Referring to FIG. 1, a flow diagram 100 shows a first embodiment of the described method. A source speech is received 101 and a voice transformation is carried out 102 by a voice transformation system. A transformed speech generated 103.

Voice transformation systems apply different transforms on the input speech depending on different tunable parameters. Examples of tunable parameters include: pitch modification parameters, spectral transformation matrices, Gaussian mixtures (GMM) coefficients, speed up/slow down ratios, noise level modification parameters, etc. The parameters may be selected from a list of preset configurations, tuned manually, or trained automatically by comparing speech samples originating from the two voices.

The transformation parameters used in the voice transformation are determined 104 and information on the transformation parameters is generated 105. The information on the transformation parameters may be one of the following: the transformation parameters themselves, inverse transformation parameters, encoded or encrypted transformation parameters or inverse transformation parameters, or an approximation of the transformation parameters or inverse transformation parameters.

This information on the transformation parameters may include an index into a remote database where the parameters themselves are stored. The index may allow the retrieval of the parameters from the database. For example, the transformation parameters may be placed on a web site and the URL of those parameters (e.g. http://www . . . ) may be encoded into the speech.

The information on the transformation parameters may include quantized transformation parameters from the voice transformation system (or the inverse transformation parameters) which are encoded in a binary form and, possibly, also compressed and encrypted. The binary data may then be encoded into the output speech using a stenography method.

The transformed speech has a steganography method applied 106 to encode the information on the transformation parameters into the transformed speech. This is done by combining the information on the transformation parameters as a steganography signal (as hidden data or a watermark) with the transformed speech to generate output speech 107. Steganography methods applied to audio data may range from simple algorithms that insert information in the form of signal noise, to complex algorithms exploiting sophisticated signal processing techniques to hide the information. Some examples of audio steganography include LSB (least significant bit) coding, parity coding, phase coding, spread spectrum and echo hiding.

Some steganographic algorithms work by manipulating different speech parameters. Those algorithms can operate directly inside the voice transformation system and this is described in the second embodiment of the described method with reference to FIG. 2.

Figure 2:
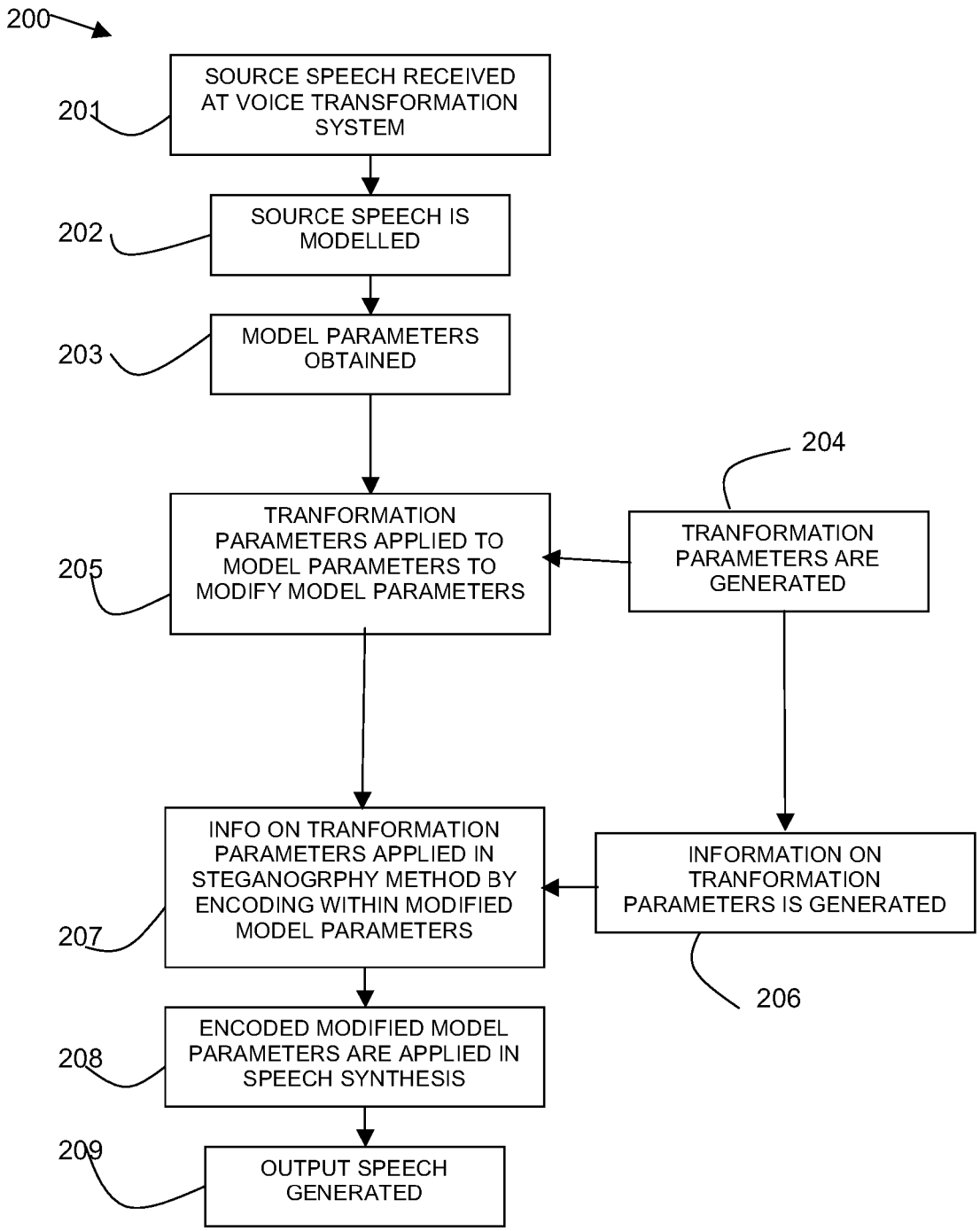
FIG. 2 is a flow diagram of a second embodiment of a method of voice transformation in accordance with the present invention.

Referring to FIG. 2, a flow diagram 200 shows an embodiment of the described method as carried out in a voice transformation system. A source speech is received 201 and the source speech is modelled 202 to obtain model parameters 203.

Transformation parameters are generated 204 which are applied to the model parameters to modify 205 the model parameters of the source speech.

Information on the transformation parameters may be generated 206 as in the method of FIG. 1. The information on the transformation parameters may be one of the following: the transformation parameters themselves, inverse transformation parameters, encoded or encrypted transformation parameters or inverse transformation parameters, or an approximation of the transformation parameters or inverse transformation parameters. The information on the transformation parameters may include quantized transformation parameters from the voice transformation system (or the inverse transformation parameters) which are encoded in a binary form and, possibly, also compressed and encrypted. The transformation parameters may be stored in a database and the information on them may be an index which allows their retrieval from the database.

The information on the transformation parameters is applied in a steganography method by encoding 207 within the modified model parameters. The encoded modified model parameters are then applied 208 in the final speech synthesis and an output speech 209 is generated.

In the second embodiment, the encoded transformation coefficients are combined with the transformed speech parameters. For example, the coefficients can be encoded as small variations on the modified pitch curve of the final voice. For example, the transformation data may be encoded in the pitch curve by the voice transformation system. Voice transformation systems usually control the pitch curve of the output signal. The pitch is usually adjusted for each short frame (5-20 msec). The integer pitch in Hertz $p_n$ can be taken for frame n and the last bit replaced with a bit from the data $d_n$:

$$p'_n = 2\left\lfloor \frac{p_n}{2} \right\rfloor + d_n$$

The output speech signal is then synthesized with the new pitch $p'_n$ instead of $p_n$. The effect is practically inaudible to a human ear but enables 1 bit/frame to be encoded. To extract the data from the output speech a pitch detector is applied on the audio in order to compute the pitch curve and then the last bit of the pitch value from each frame is extracted.

Figure 3:
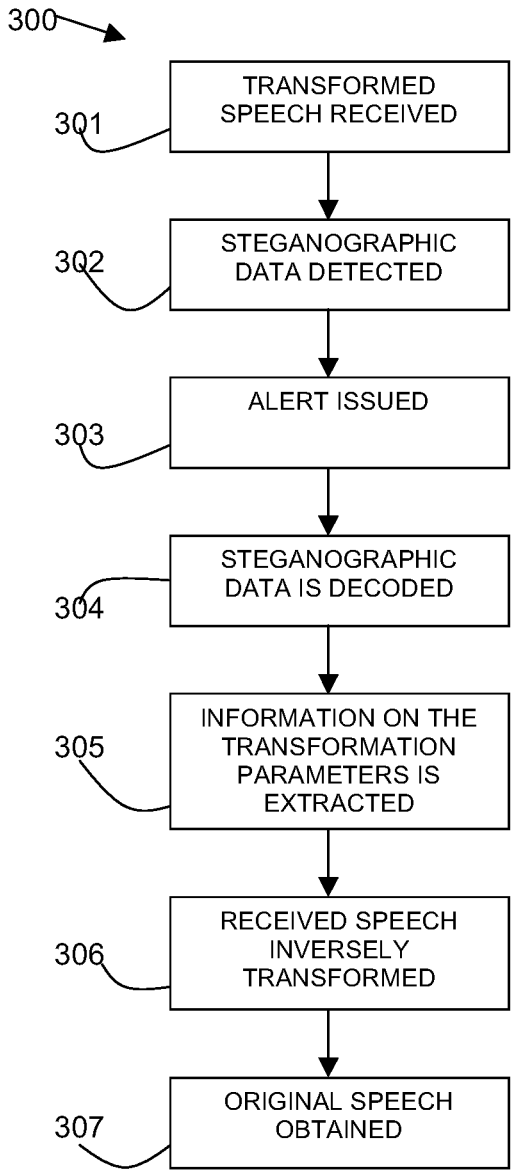
FIG. 3 is a flow diagram of an embodiment of a method of reconstruction of a voice transformation in accordance with the present invention.

Referring to FIG. 3, a flow diagram 300 shows an embodiment of the described method of reconstruction of a voice transformation.

A transformed speech is received 301 and the presence of a watermark or other steganographic data is detected 302. An alert may be issued 303 on detection of steganographic data to alert a receiver to the fact that the received speech is transformed speech and not in the original voice.

The steganographic data is decoded 304 and information on the transformation parameters is extracted 305. If the information on the transformation parameters is an index to the transformation parameters stored elsewhere, the transformation parameters are retrieved. The information on the transformation parameters is applied to inversely transform 306 the received speech to obtain 307 as close to the original speech as possible.

Some or all of the information on the transformation parameters encoded by the steganography may also be encrypted by various ciphers known in the literature. This way only those who have access to the decipher key (e.g. law enforcement agencies) can decipher the information on the transformation parameters and transform the speech back to the original voice.

Instead of encoding the transformation parameters the system may encode the inverse parameters. If the transformation is not invertible (e.g. the sample rate is reduced) then the system can encode the parameters that will bring the transformed voice back as close as possible to the original voice.

The voice transformation parameter set is usually computed by an optimization process that finds the best parameters that when applied to the set of source speech samples will make them sound as close as possible to a set of a target sample. Some of those parameters have simple inversion. For example, if to get from the source to the destination the pitch has been increased by $\Delta p$, then to reverse the process the pitch should be lowered by $\Delta p$. However, since the synthesis process is not linear and since some parameters are dynamically selected based on the source signal then it is not always easy to invert the process.

One embodiment used in the described method, trains a new set of inverse voice transformation parameters that best transform the synthesized speech into the source speech and encodes those parameters within the transformed speech.

Figure 4:
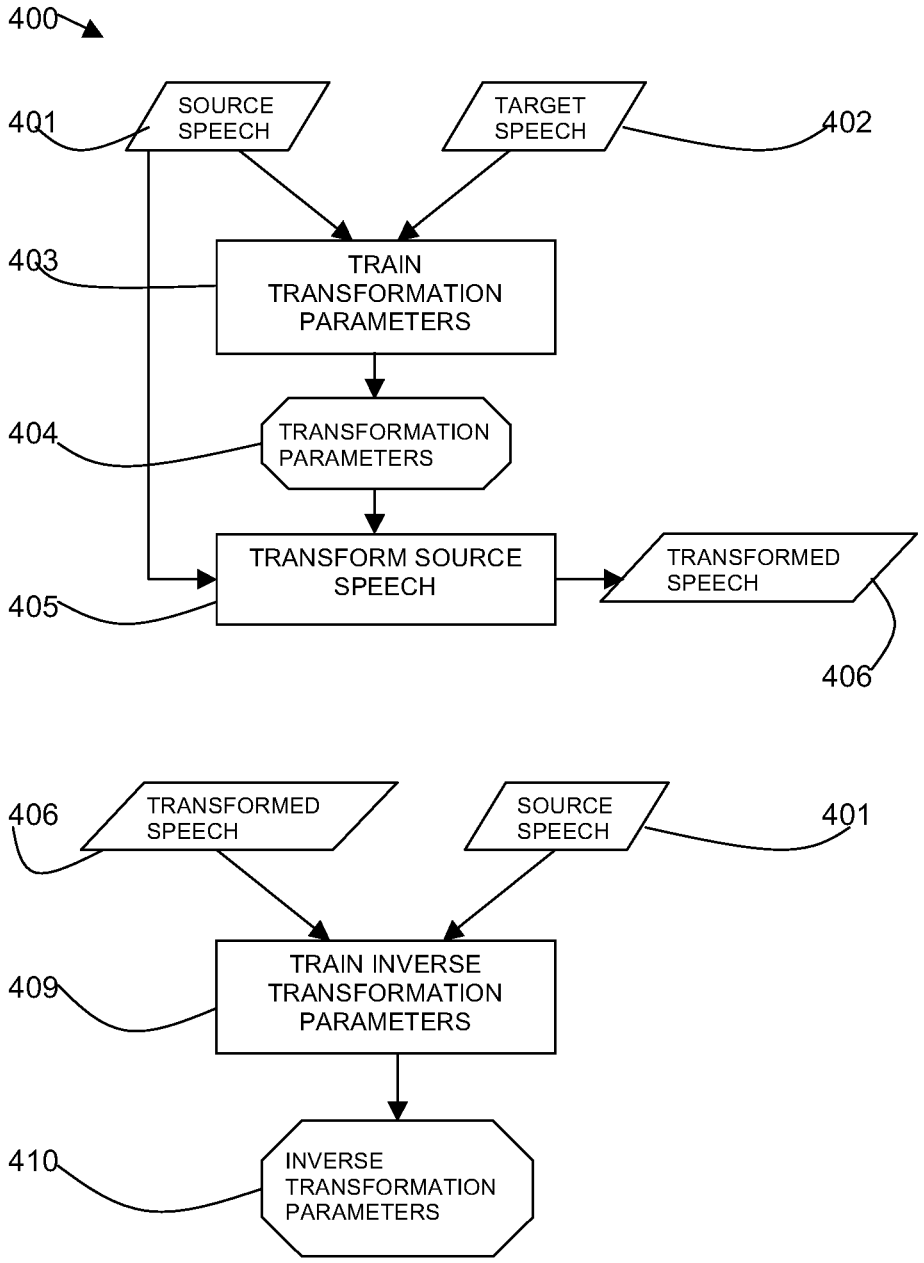
FIG. 4 is a flow diagram of an aspect of the method of reconstruction of a voice transformation in accordance with the present invention.

Referring to FIG. 4, a flow diagram 400 shows a method of training inverse parameters. A source speech 401 and a target speech 402 are used as inputs to train 403 transformation parameters 404. The source speech 401 is transformed 405 using the trained transformation parameters 404 to output a transformed speech 406.

The inverse parameters may be trained by inputting the transformed speech 406 and the source speech 401 to train 409 inverse parameters 410. The trained inverse parameters may be used to reconstruct the transformed speech to as close as possible to the source speech.

Figure 5:
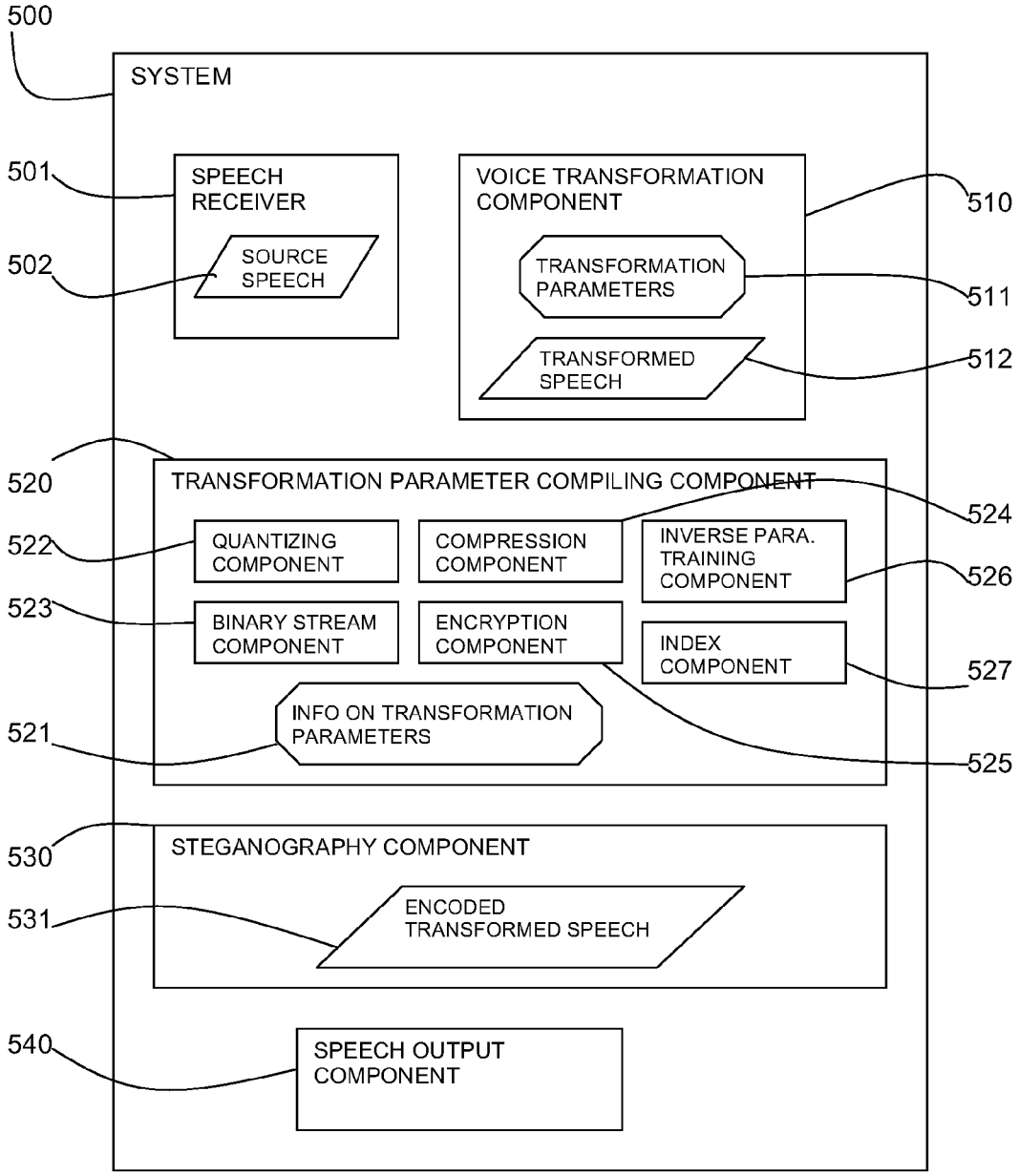
FIG. 5 is a block diagram of a first embodiment of a system in accordance with the present invention.

Referring to FIG. 5, a block diagram shows a first embodiment of the described system 500. A system 500 is provided including a speech receiver 501 for receiving source speech 502 to be processed by a voice transformation component 510 which uses transformation parameters 511 to provide transformed speech 512.

A transformation parameter compiling component 520 may be provided which compiles the transformation parameters 511 into information 521 to be encoded. The transformation parameter compiling component 520 may include a quantizing component 522 for quantizing the parameters, a binary stream component 523 for converting the quantized parameters into a binary stream, a compression component 524 for compressing the information, and an encryption component 525 for encrypting the information. The transformation parameter compiling component 520 may also include an inverse parameter training component 526 for providing inverse transformation parameters from the input speech and the transformed speech. The transformation parameter compiling component 520 may include an index component 527 for indexing remotely stored transformation parameters in the information 521 to be encoded.

A steganography component 530 is provided for encoding the information 521 on the transformation parameters into the transformed speech 512 to produce encoded transformed speech 531. A speech output component 540 may be provided for outputting the transformed speech with encoded transformation parameter information.

Figure 6:
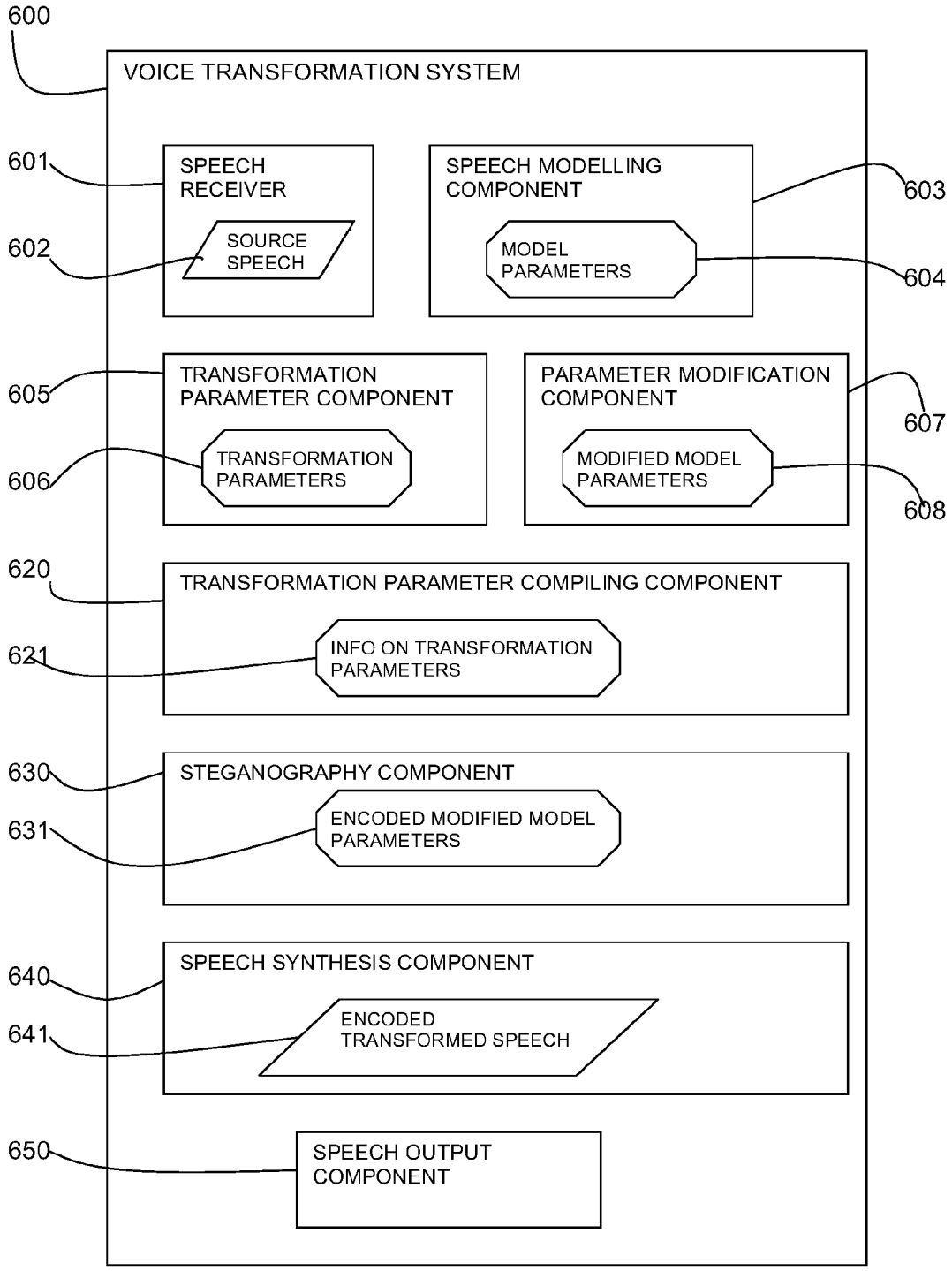
FIG. 6 is a block diagram of a second embodiment of a system in accordance with the present invention.

Referring to FIG. 6, a block diagram shows a second embodiment of the described system which is integrated into a voice transformation system 600.

The voice transformation system 600 may include a speech receiver 601 for receiving source speech 602 to be processed. A speech modelling component 603 is provided which generates model parameters 604 of the source speech 602. A transformation parameter component 605 generates transformation parameters 606 to be used. A parameter modification component 607 may be provided for applying the transformation parameters 606 to the model parameters 604 to obtain modified model parameters 608.

A transformation parameter compiling component 620 may be provided which compiles the transformation parameters 606 into information 621 to be encoded. The compiling component 620 may include one or more of the components described in relation to the compiling component 520 of FIG. 5.

A steganography component 630 is provided for encoding the information 621 into the modified model parameters 608 to generate encoded modified model parameters 631.

A speech synthesis component 640 may be provided for synthesizing the source speech with the encoded modified model parameters 631 to generate encoded transformed speech 641. A speech output component 650 is provided for outputting a speech output in the form of the transformed speech with encoded transformation parameter information.

Figure 7:
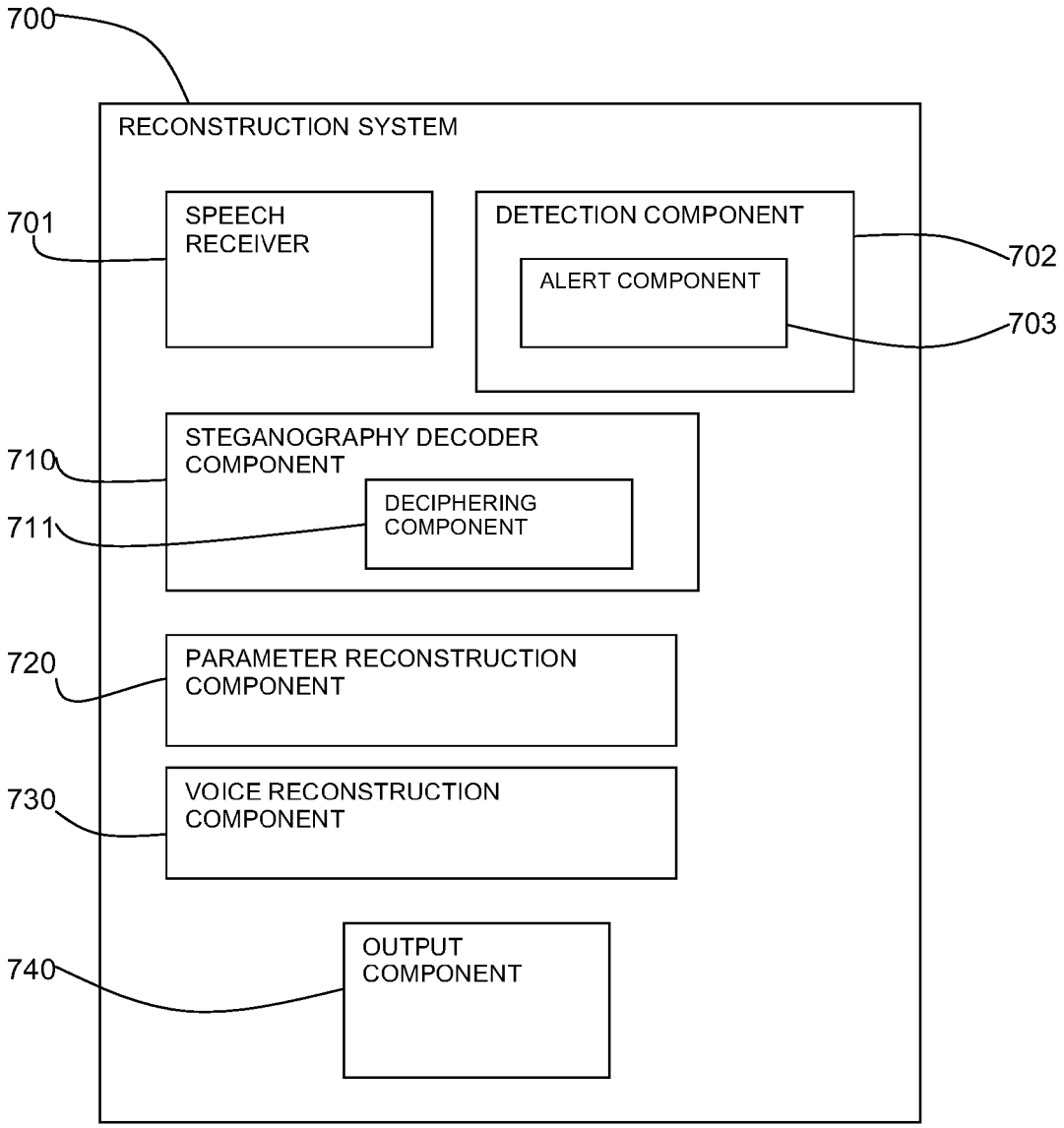
FIG. 7 is a block diagram of a voice reconstruction system in accordance with an aspect of the present invention.

Referring to FIG. 7, a block diagram shows a reconstruction system 700 for reconstructing the source speech from the transformed speech. A speech receiver 701 is provided for receiving input speech. A detection component 702 may be provided to detect if the input speech includes a steganography signal. An alert component 703 may be provided to issue an alert if a steganography signal is detected to inform a user that the input speech is not an original voice.

A steganography decoder component 710 may be provided to extract the encoded information on the transformation parameters. The decoder component 710 may include a deciphering component 711 for deciphering the encoded information if it is encrypted. A parameter reconstruction component 720 may be provided to reconstruct the transformation parameters or inverse transformation parameters from the encoded information. The parameter reconstruction component 720 may retrieve indexed transformation parameters from a remote location.

A voice reconstruction component 730 may be provided to reconstruct the source speech or as close to the original source speech as possible. An output component 740 may be provided to output the reconstructed speech.

Figure 8:
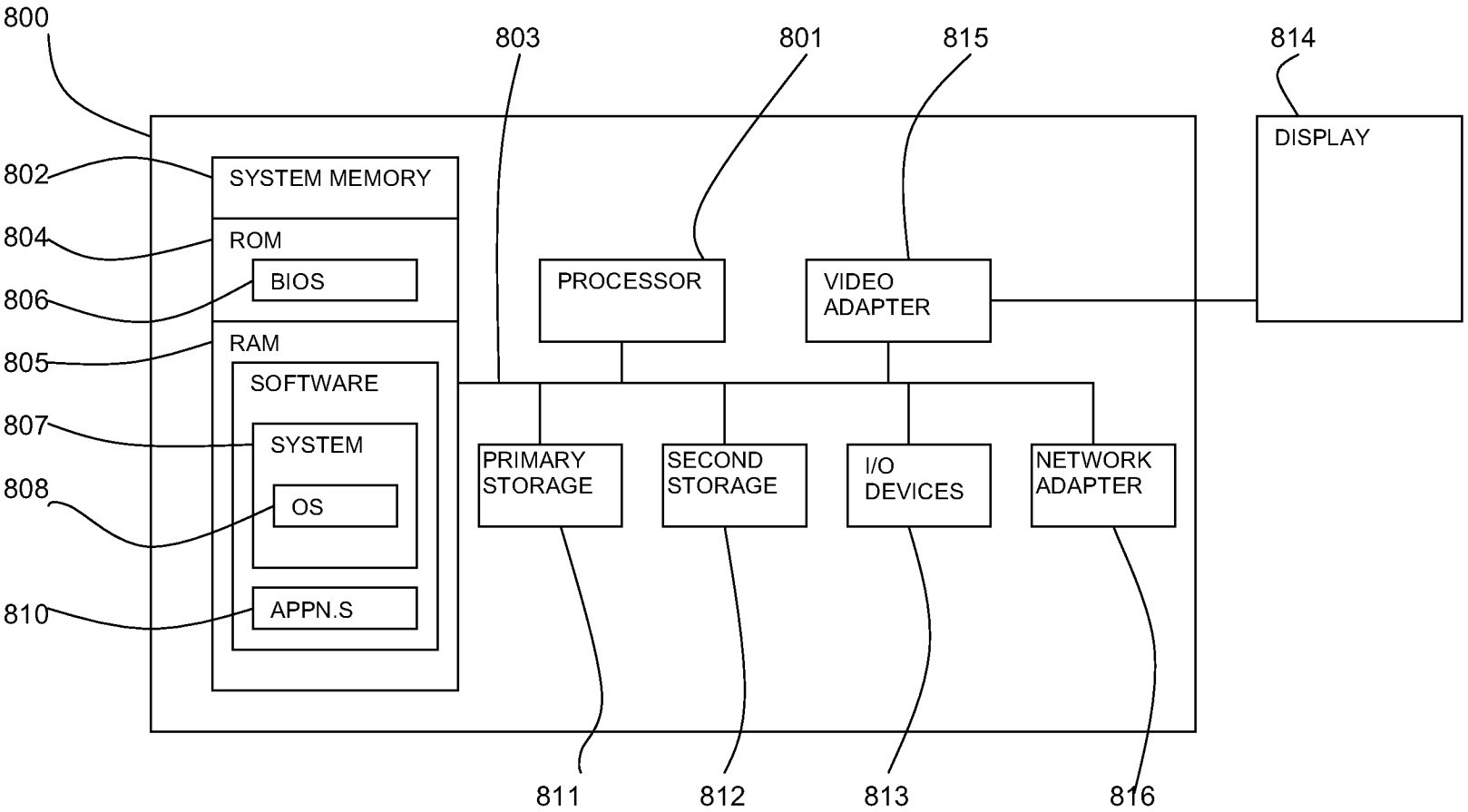
FIG. 8 is a block diagram of a computer system in which the present invention may be implemented.

Referring to FIG. 8, an exemplary system for implementing aspects of the invention includes a data processing system 800 suitable for storing and/or executing program code including at least one processor 801 coupled directly or indirectly to memory elements through a bus system 803. The memory elements can include local memory employed during actual execution of the program code, bulk storage, and cache memories which provide temporary storage of at least some program code in order to reduce the number of times code must be retrieved from bulk storage during execution.

The memory elements may include system memory 802 in the form of read only memory (ROM) 804 and random access memory (RAM) 805. A basic input/output system (BIOS) 806 may be stored in ROM 804. System software 807 may be stored in RAM 805 including operating system software 808. Software applications 810 may also be stored in RAM 805.

The system 800 may also include a primary storage means 811 such as a magnetic hard disk drive and secondary storage means 812 such as a magnetic disc drive and an optical disc drive. The drives and their associated computer-readable media provide non-volatile storage of computer-executable instructions, data structures, program modules and other data for the system 800. Software applications may be stored on the primary and secondary storage means 811, 812 as well as the system memory 802.

The computing system 800 may operate in a networked environment using logical connections to one or more remote computers via a network adapter 816.

Input/output devices 813 can be coupled to the system either directly or through intervening I/O controllers. A user may enter commands and information into the system 800 through input devices such as a keyboard, pointing device, or other input devices (for example, microphone, joy stick, game pad, satellite dish, scanner, or the like). Output devices may include speakers, printers, etc. A display device 814 is also connected to system bus 803 via an interface, such as video adapter 815.

A voice transformation system with the above components may be provided as a service to a customer over a network. The detection of a transformed voice and the conversion back to the original voice may also be provided as a service to a customer over a network.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A method for voice transformation, comprising:

transforming a source speech of a person using transformation parameters, wherein the transforming comprises modifying the source speech to sound as if the source speech were spoken by a different person; and encoding information on the transformation parameters in an output speech using steganography, wherein the source speech can be reconstructed using the output speech and the information on the transformation parameters, and wherein at least one of the transforming and the encoding is performed by a processor.

2. The method as claimed in claim 1, wherein encoding information on the transformation parameters includes:

encoding the information into the transformed speech after the transforming step by combining a steganographic signal including the information on the transformation parameters and the transformed speech to generate the output speech.

3. The method as claimed in claim 1, wherein encoding information on the transformation parameters includes:

encoding the information during transformation of the input speech by combining the information on the transformation parameters with the transformed speech parameters.

4. The method as claimed in claim 1, wherein the information on the transformation parameters is usable to reconstruct the output speech to a close approximation to the source speech.

5. The method as claimed in claim 1, wherein the information on the transformation parameters includes one of the group of: the transformation parameters, the inverse transformation parameters, compressed or encrypted transformation parameters or inverse transformation parameters, an approximation of the transformation parameters or inverse transformation parameters, a trained set of inverse transformation parameters from a source speech and the transformed speech, an index to remotely stored transformation parameters or inverse transformation parameters.

6. The method as claimed in claim 1, including:

compiling the information on the transformation parameters including:

quantizing the transformation parameters; and converting the quantized transformation parameters to a binary stream.

7. The method as claimed in claim 1, including:

compiling the information on the transformation parameters by training inverse parameters to convert a transformed speech into a source speech.

8. The method as claimed in claim 1, including:

storing the transformation parameters or inverse transformation parameters at a remote location; and compiling the information on the transformation parameters including providing an index to the remote storage.

9. A method for reconstructing a voice transformation, comprising:

receiving an output speech of a voice transformation system wherein the output speech is a source speech of a person which was transformed to sound as if the source speech were spoken by a different person, wherein the output speech comprises encoded information on the transformation parameters using steganography;

extracting the information on the transformation parameters; and carrying out an inverse transformation of the output speech to obtain an approximation of the source speech, wherein at least one of the receiving, the extracting and the carrying out is performed by a processor.

10. The method as claimed in claim 9, including:

detecting the encoded information in the received output speech; and issuing an alert that the received output speech is transformed speech.

11. The method as claimed in claim 9, wherein extracting the information on the transformation parameters extracts encrypted information, and the method including:

using a decipher key to decipher the encrypted information on the transformation parameters.

12. A system for voice transformation comprising:

a processor;

a voice transformation component for transforming a source speech of a person using transformation parameters, wherein the transforming comprises modifying the source speech to sound as if the source speech were spoken by a different person; and a steganography component for encoding information on the transformation parameters in an output speech using steganography;

wherein the source speech can be reconstructed using the output speech and the information on the transformation parameters.

13. The system as claimed in claim 12, wherein the steganography component encodes the information into the output of the voice transformation component by combining a steganographic signal including the information on the transformation parameters and the transformed speech to generate the output speech.

14. The system as claimed in claim 12, wherein the steganography component is integrated in the voice transformation component and encodes the information during transformation of the input speech by combining the information on the transformation parameters with the transformed speech parameters.

15. The system as claimed in claim 14, wherein the voice transformation component includes a transformation parameter component which provides transformation parameters to a parameter modification component and the steganography component.

16. The system as claimed in claim 12, including a compiling component for compiling the information on the transformation parameters including:

a quantizing component for quantizing the transformation parameters; and a binary stream component for converting the quantized transformation parameters to a binary stream.

17. The system as claimed in claim 12, including:

a compiling component for compiling the information on the transformation parameters by training inverse parameters to convert a transformed speech into a source speech.

18. The system as claimed in claim 12, including:

a compiling component for compiling the information on the transformation parameters by a storing the transformation parameters or inverse transformation parameters at a remote location and providing an index to the remote storage.

19. The system as claimed in claim 12, wherein the information on the transformation parameters includes one of the group of: the transformation parameters, the inverse transformation parameters, encoded or encrypted transformation parameters or inverse transformation parameters, an approximation of the transformation parameters or inverse transformation parameters, a trained set of inverse transformation parameters from a source speech and the transformed speech, an index to remotely stored transformation parameters or inverse transformation parameters.

20. A system for reconstructing a voice transformation, comprising:

a processor;

a speech receiver for receiving an input speech, wherein the input speech a source speech of a person which was transformed to sound as if the source speech were spoken by a different person, wherein the output speech comprises encoded information on the transformation parameters using steganography;

a steganography decoder component for decoding the information on the transformation parameters from the input speech; and a voice reconstruction component for carrying out an inverse transformation of the input speech to obtain an approximation of the source speech.

21. The system as claimed in claim 20, including:

a detection component for detecting the encoded information in the received output speech; and an alert component for issuing an alert that the received input speech is transformed speech.

22. The system as claimed in claim 20, wherein the steganography decoder component includes a deciphering component for using a decipher key to decipher the encrypted information on the transformation parameters.

23. A computer program product for voice transformation, the computer program product comprising:

a non-transitory computer readable storage medium having computer readable program code embodied therewith, the computer readable program code comprising:

computer readable program code configured to cause a processor to:

transform a source speech of a person using transformation parameters, wherein the transform comprises modifying the source speech to sound as if the source speech were spoken by a different person; and encode information on the transformation parameters in an output speech using steganography, wherein the source speech can be reconstructed using the information on the output speech and the transformation parameters.

* * * * *